US008834291B2

(12) United States Patent
Ban

(10) Patent No.: US 8,834,291 B2
(45) Date of Patent: Sep. 16, 2014

(54) GOLF CLUB HEAD

(75) Inventor: Wataru Ban, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 588 days.

(21) Appl. No.: 13/050,618

(22) Filed: Mar. 17, 2011

(65) Prior Publication Data

US 2011/0300967 A1 Dec. 8, 2011

(30) Foreign Application Priority Data

Jun. 2, 2010 (JP) ..... 2010-127305

(51) Int. Cl.
*A63B 53/04* (2006.01)
*A63B 53/00* (2006.01)

(52) U.S. Cl.
CPC ..... *A63B 53/047* (2013.01); *A63B 2053/0445* (2013.01); *A63B 2053/0479* (2013.01); *A63B 2053/0416* (2013.01); *A63B 53/04* (2013.01); *A63B 2053/0408* (2013.01); *A63B 2053/005* (2013.01)
USPC ..... 473/331

(58) Field of Classification Search
USPC ..... 473/324–350
See application file for complete search history.

(56) References Cited

U.S. PATENT DOCUMENTS 4,413,825 A * 11/1983 Sasse ..... 473/331
7,594,863 B2 * 9/2009 Ban ..... 473/331
7,674,188 B2 * 3/2010 Ban ..... 473/330
7,691,007 B2 * 4/2010 Ban et al. ..... 473/330
7,695,377 B2 * 4/2010 Yamagishi et al. ..... 473/331
7,798,917 B2 9/2010 Nguyen et al.
7,798,918 B2 9/2010 Ban et al.
7,819,756 B2 * 10/2010 Ban et al. ..... 473/330
7,901,297 B2 * 3/2011 Ban et al. ..... 473/331
8,012,036 B2 * 9/2011 Nakamura ..... 473/290
8,066,586 B2 * 11/2011 Solheim et al. ..... 473/330
8,092,320 B2 * 1/2012 Yamagishi et al. ..... 473/331
8,113,965 B2 * 2/2012 Ban ..... 473/330
8,118,688 B2 * 2/2012 Nakamura ..... 473/331
8,376,877 B1 * 2/2013 Galloway ..... 473/330
2008/0132351 A1 6/2008 Ban et al.
2009/0036228 A1 2/2009 Ban et al.
2009/0247318 A1 * 10/2009 Ban et al. ..... 473/331

FOREIGN PATENT DOCUMENTS

GB 2444376 A * 6/2008 ..... A63B 53/04
JP 08-196666 A 6/1996
JP 9-084909 A 3/1997
JP 2007-202633 A 8/2007
JP 2007202633 A * 8/2007
JP 2007-301016 A 11/2007
JP 2007-301017 A 11/2007
JP 2007-319344 A 12/2007
JP 2008005994 A * 1/2008
JP 2008-114007 A 5/2008
JP 2008-136833 A 6/2008

(Continued)

*Primary Examiner* — Alvin Hunter
(74) *Attorney, Agent, or Firm* — Sughrue Mion, PLLC

(57) ABSTRACT

This invention provides a golf club head including a plurality of parallel scorelines formed in its face surface, and a plurality of grooves which are formed in the face surface and have a width narrower than the scorelines. Rounded portions are formed on the edges of the scorelines. The plurality of grooves are formed at positions on the two sides of each of the scorelines to extend parallel to the scorelines.

8 Claims, 5 Drawing Sheets

(56) References Cited

FOREIGN PATENT DOCUMENTS

| | | | | |
|---|---|---|---|---|
| JP | 2008-161658 | A | | 7/2008 |
| JP | 2009-028101 | A | | 2/2009 |
| JP | 2009-034393 | A | | 2/2009 |
| JP | 2009-066312 | A | | 4/2009 |
| JP | 2009-148538 | A | | 7/2009 |
| JP | 2009-261886 | A | | 11/2009 |
| JP | 2010-035846 | A | | 2/2010 |
| JP | 2010148659 | A | * | 7/2010 |
| JP | 2011234748 | A | * | 11/2011 |
| JP | 2011234749 | A | * | 11/2011 |

* cited by examiner

GOLF CLUB HEAD

BACKGROUND OF THE INVENTION

1. Field of the Invention

The present invention relates to a golf club head.

2. Description of the Related Art

In general, a plurality of parallel linear grooves are formed in the face surface of a golf club head to extend in the toe-to-heel direction (for example, Japanese Patent Laid-Open Nos. 9-84909 and 2007-202633). These grooves are called, for example, scorelines, marking lines, or face lines (they will be referred to as scorelines in this specification). These scorelines have an effect of increasing the back spin amount on a struck golf ball, or suppressing a significant decrease in back spin amount on a struck golf ball upon a shot in rainy weather or that from the rough. To adjust the spin amount on a struck golf ball, a technique of forming grooves different from the scorelines in the face surface (for example, Japanese Patent Laid-Open No. 2007-202633), and a technique of forming a plurality of types of grooves in the face surface (for example, Japanese Patent Laid-Open No. 2010-35846) have also been proposed.

A rule concerning the scorelines of an athletic golf club head stipulates that the edge of each scoreline must fall within a virtual circle which has a radius of 0.011 inches and is concentric with a virtual circle which has a radius of 0.010 inches and is inscribed in both the side wall of this scoreline and the face surface. To comply with this rule, it is possible to form rounded portions on the edges of the scorelines.

On the other hand, the scorelines serve as indices for matching the orientation of the face surface with the target direction upon address. When the edges of the scorelines are chamfered, the boundaries between the scorelines and the face surface often become visually obscure. If the scorelines are hard to see upon address, it is difficult to match the orientation of the face surface with the target direction. To improve the visibility of the scorelines, it is possible to color the scorelines. However, when a colorant is used to coat the scorelines, the coating material may peel off or degrade the spin performance of a golf ball.

SUMMARY OF THE INVENTION

It is an object of the present invention to improve the visibility of scorelines.

According to the present invention, there is provided a golf club head including a plurality of parallel scorelines formed in a face surface thereof, and a plurality of grooves which are formed in the face surface and have a width narrower than the scorelines, wherein rounded portions are formed on edges of the scorelines, and the plurality of grooves are formed at positions on two sides of each of the scorelines to extend parallel to the scorelines.

Further features of the present invention will become apparent from the following description of exemplary embodiments with reference to the attached drawings.

DESCRIPTION OF THE EMBODIMENTS

Figure 1:
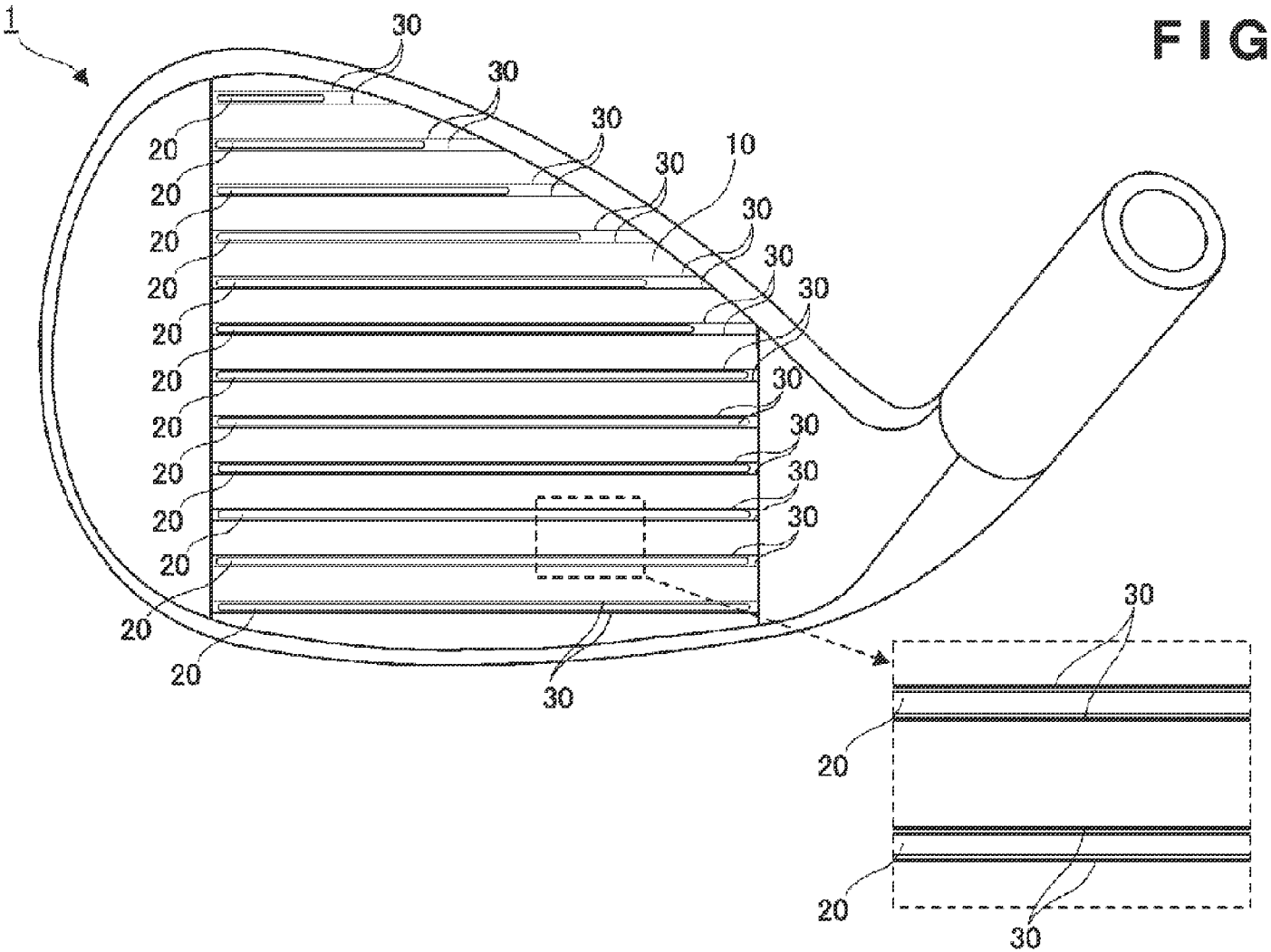
FIG. 1 shows an external view of a golf club head 1 and a partial enlarged view of a face surface 10 according to an embodiment of the present invention.
Figure 2:
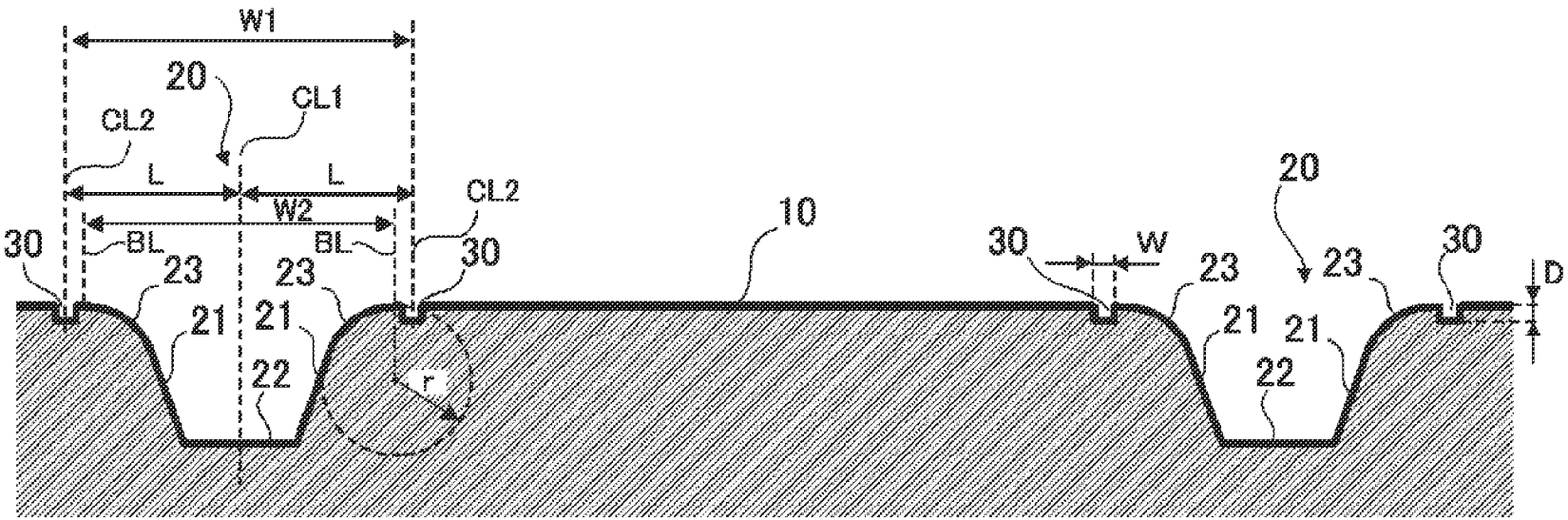
FIG. 2 is a sectional view of scorelines 20 and grooves 30 taken in a direction perpendicular to their longitudinal direction (the toe-to-heel direction)

FIG. 1 shows an external view of a golf club head 1 and a partial enlarged view of a face surface 10 according to an embodiment of the present invention, and FIG. 2 is a sectional view of scorelines 20 and grooves 30 taken in a direction perpendicular to their longitudinal direction (the toe-to-heel direction). FIG. 1 illustrates an example in which the present invention is applied to an iron type golf club head. The present invention is suitable for an iron type golf club head and, more particularly, for middle iron, short iron, and wedge type golf club heads. More specifically, the present invention is suitable for a golf club head with a loft angle of 30° (inclusive) to 70° (inclusive) and a head weight of 240 g (inclusive) to 320 g (inclusive). However, the present invention is also applicable to wood type and utility (hybrid) type golf club heads.

The golf club head 1 has a plurality of scorelines 20 formed in its face surface (striking surface) 10. The scorelines 20 are parallel linear grooves extending in the toe-to-heel direction. Although the scorelines 20 align themselves at an equal interval (equal pitch) in this embodiment, they may align themselves at different intervals. In this embodiment, the scorelines 20 have uniform cross-sectional shapes throughout their entire longitudinal portions except for their two ends (their toe- and heel-side ends). Also, the scorelines 20 have the same cross-sectional shape.

The scoreline 20 has a pair of side walls 21 and a bottom wall 22, and has its cross-section formed in a trapezoidal shape which is bilaterally symmetrical about a center line CL1. Note that the cross-sectional shape of the scoreline 20 is not limited to a trapezoidal shape, and may be another shape such as a V shape. A rounded portion with a radius r is formed on an edge 23 of the scoreline 20. The radius r is, for example, 0.05 mm (inclusive) to 0.3 mm (inclusive). A line BL indicates the boundary between the rounded portion of the edge 23 and the face surface 10.

The plurality of grooves 30 are formed in the face surface 10. The plurality of grooves 30 are formed only at positions on the two sides of each scoreline 20 to extend parallel to the scorelines 20. That the grooves 30 and scorelines 20 are parallel to each other includes a case in which the intersection angle between their infinite extension lines is 0° (inclusive) to 20° (inclusive) for giving an allowance for, for example, manufacturing errors.

Upon forming the grooves 30 only on the two sides of each scoreline 20, the individual scorelines 20 are visually enhanced as if they had a width wider than their actual width. Hence, the visibility of the scorelines 20 can be improved even when rounded portions are formed on the edges 23 of the scorelines 20. Also, the back spin amount on a struck golf ball can be increased by the grooves 30.

Although the grooves 30 are formed only at positions on the two sides of each scoreline 20 in this embodiment, they need only be formed at least at positions on the two sides of each scoreline 20. Nevertheless, a function of improving the visibility of the scorelines 20 is most greatly exhibited by forming the grooves 30 only at positions on the two sides of each scoreline 20.

In this embodiment, the plurality of grooves 30 have the same shape, a width W, a depth D, and a rectangular cross-sectional shape. The width W is narrower than that of the scoreline 20 (the width defined by the 30-degree measurement method). The width W is desirably, for example, 50 μm (inclusive) to 500 μm (inclusive) from the viewpoint of improving the visibility of the scorelines 20. In an iron club set, the width W is changed for each iron number. In, for example, an iron club with a small loft angle, the width W is set relatively wide, thereby making it possible to equalize the visibility of the scorelines 20 among the individual iron clubs.

In this embodiment, the depth D is smaller than that of the scorelines 20. The roughness of the face surface of an athletic golf club head has a predetermined limit defined by a maximum height (Ry) of 25 μm or less. Hence, the depth D is preferably 5 μm (inclusive) to 25 μm (inclusive).

In this embodiment, the grooves 30 are formed in the face surface 10 along the boundary line BL. The grooves 30 are formed in the face surface 10 without making them fall outside the boundary line BL toward the edge 23, and thereby can be formed without adversely affecting the performance of the grooves 30.

In this embodiment, the grooves 30 are formed on the two sides of each scoreline 20 at positions which are spaced apart from the center line CL1 of the scoreline 20 by an equal distance L1. Note that the distance L1 is determined with reference to a center line CL2 of each groove 30. Upon forming the grooves 30 at positions which are spaced apart from the center line CL1 by an equal distance, the visibility of the scorelines 20 can be improved free from any sense of discomfort in appearance. As the grooves 30 are formed in closer proximity to the scorelines 20, the visibility of the scorelines 20 can be more greatly improved free from any sense of discomfort in appearance. Although the edge of the groove 30 on the side of the scoreline 20 is slightly separated from the boundary line BL in this embodiment, it is preferable to match the edge of the groove 30 with the boundary line BL. Also, letting W1 be the distance between the center lines CL2 of the grooves 30, and W2 be the distance between the boundary lines BL, the distance W1 preferably satisfies a relation:

$$W2+W \leq W1 \leq W2+4\times W$$

A method of forming scorelines 20 and grooves 30 will be described next. Scorelines 20 can be formed by, for example, forging, molding, cutting, or laser processing. Grooves 30 can be formed by, for example, cutting or laser processing.

Figure 3:
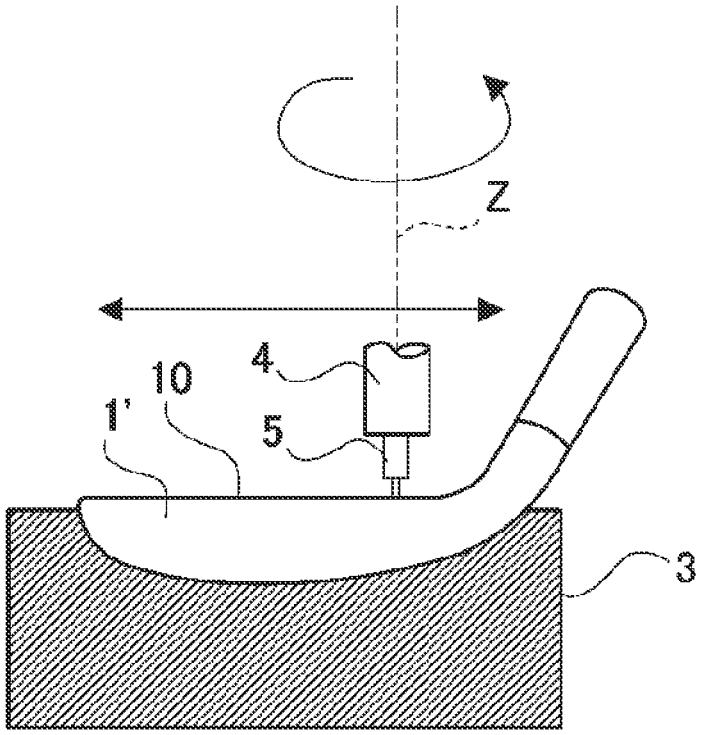
FIG. 3 is a view for explaining a method of forming grooves 30 by an NC milling machine.

A case in which scorelines 20 are formed by forging and grooves 30 are formed by milling will be described herein with reference to FIG. 3. FIG. 3 is a view for explaining a method of forming grooves 30 by an NC milling machine.

First, a primary shaped product 1' of a golf club head 1, in which scorelines 20 are formed by forging, is fabricated. In the primary shaped product 1', no grooves 30 are formed in the face surface 10. Next, grooves 30 are formed by milling. The primary shaped product 1' in which no grooves 30 are formed is fixed to an NC milling machine via a jig 2, as shown in FIG. 3. Although the face surface 10 is shaped integrally with the golf club head 1 in this embodiment, a face member which forms the face surface 10 and the head body may be provided as separate members and bonded to each other.

The NC milling machine includes a spindle 4 which is rotationally driven about the Z-axis, and a cutting tool (end mill) 5 attached to the lower end of the spindle 4. The distal end shape of the cutting tool 5 conforms to the cross-sectional shape of the groove 30.

After the plane coordinates of the face surface 10 are set on the NC milling machine, the spindle 4 is rotationally driven to cut the face surface 10 while relatively moving the face surface 10 (primary shaped product 1') or the cutting tool 5 in the direction to form grooves 30. When one groove 30 is formed in the face surface 10, the cutting tool 5 is separated from the face surface 10. After that, the cutting tool 5 is relatively moved in the direction in which grooves 30 are aligned to form the next groove 30, thereby sequentially forming grooves 30.

Note that when the grooves 30 are formed in the face surface 10, it is often the case that the face surface 10 becomes more likely to wear out. To prevent this, after the formation of the grooves 30, a surface treatment for hardening the face surface 10 is preferably performed. Examples of such a surface treatment include carburizing, nitriding, soft nitriding, PVD (Physical Vapor Deposition), ion plating, diamond-like carbon coating, and plating. Especially a surface treatment which modifies a surface without forming another metal layer on the surface, such as carburizing or nitriding, is preferable.

Other Embodiments

Figure 4A:
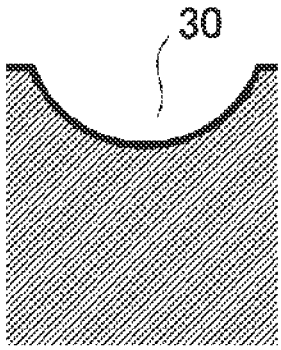
FIGS. 4A to 4E are sectional views showing other examples of the grooves 30.
Figure 4B:
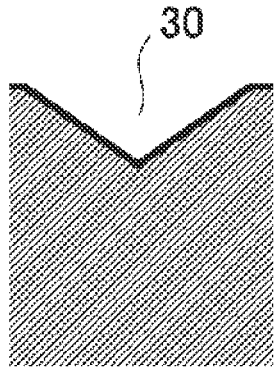
Figure 4C:
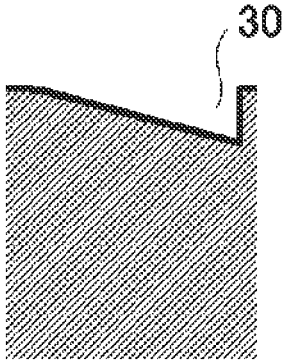
Figure 4D:
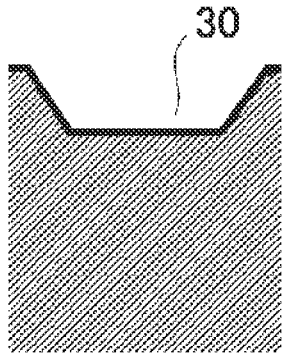

Although the cross-sectional shape of the groove 30 is a rectangular shape, it can be another shape. FIGS. 4A to 4E are sectional views showing other examples of the grooves 30. FIG. 4A illustrates an example in which a groove 30 has an arcuated cross-sectional shape. FIG. 4B illustrates an example in which the groove 30 has a triangular (isosceles triangular) cross-sectional shape. FIG. 4C also illustrates an example in which the groove 30 has a triangular cross-sectional shape and, more specifically, has a bilaterally asymmetrical triangular (right-angled triangular) cross-sectional shape. In this manner, the groove 30 may have a bilaterally asymmetrical cross-sectional shape. FIG. 4D illustrates an example in which the groove 30 has a trapezoidal cross-sectional shape.

Figure 4E:
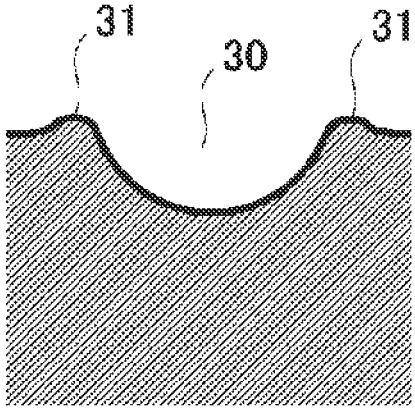

FIG. 4E illustrates an example in which protrusions 31 are formed on the edges of the groove 30 to be ridged from the face surface. Although the cross-sectional shape of the groove 30 is an arcuated shape in the example shown in FIG. 4E, it may be another shape. Upon providing the protrusions 31, the back spin amount on a struck golf ball can be increased. When the groove 30 is formed by cutting which uses milling as mentioned above, the protrusions 31 can be formed as burrs by appropriately setting the cutting conditions. Also, when the groove 30 is formed by laser processing, the protrusions 31 can be spontaneously formed by appropriately setting the laser irradiation conditions.

Figure 5A:
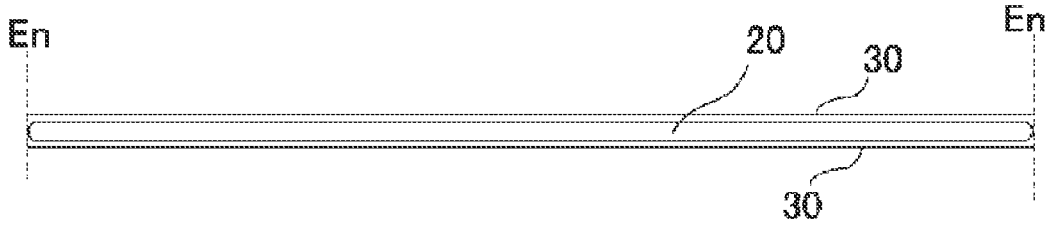
FIGS. 5A to 5B are external views showing other examples of the grooves 30.

The groove 30 preferably has a length at least equal to that of a scoreline 20. In this case, the groove 30 may have a length longer than the scoreline 20, as shown in FIG. 1, or a length equal to the distance between two ends En of the scoreline 20, as shown in FIG. 5A.

Figure 5B:
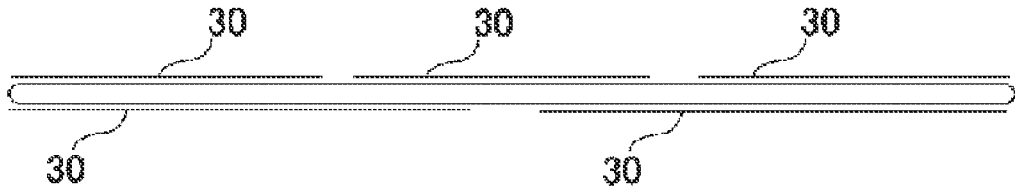

Although each groove 30 forms one continuous groove in the above-described embodiments, it may form an intermittent groove on the same straight line, as shown in FIG. 5B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-127305, filed Jun. 2, 2010, which is hereby incorporated by reference herein in its entirety.

What is claimed is:

1. A golf club head including a plurality of parallel scorelines formed in a face surface thereof, and a plurality of grooves which are formed in the face surface and have a width W narrower than the scorelines, wherein rounded portions are formed on edges of the scorelines, the plurality of grooves are formed only at positions on two sides of each of the scorelines to extend parallel to the scorelines, and a distance W1 between center lines of the closest groove formed on one side of one of the scorelines and the closest groove formed on the other side of the one of the scorelines, and a distance W2 between boundary lines of each of the rounded portions of the one of the scorelines and the face surface satisfy $$W2+W \leq W1 \leq W2+4\times W \text{ for each of the scorelines.}$$

2. The head according to claim 1, wherein each of the plurality grooves has a length at least equal to a length of the closest scoreline.

3. The head according to claim 1, wherein a depth of each of the plurality of grooves is 5 μm (inclusive) to 25 μm (inclusive).

4. The head according to claim 1, wherein an edge of each of the plurality of grooves is ridged.

5. The head according to claim 1, wherein each of the plurality of grooves is formed by one of cutting and laser processing.

6. The head according to claim 1, wherein each of the plurality of grooves is formed in the face surface along a boundary line between each of the rounded portions and the face surface.

7. The head according to claim 1, wherein each of the rounded portions has radius r.

8. The head according to claim 1, wherein a distance W3 between center lines of a pair of the grooves positioned between adjacent scorelines, and the distance W1 satisfy $$W3>W1$$

for each pair of the grooves positioned between adjacent scorelines.

* * * * *